United States Patent [19]

Haney et al.

[11] 4,278,016

[45] Jul. 14, 1981

[54] APPARATUS FOR MAKING MODULES

[75] Inventors: Donald J. Haney, San Jose; Andrew J. Gaudette, Livermore, both of Calif.

[73] Assignee: Cotton Machinery Company, Inc., Livermore, Calif.

[21] Appl. No.: 63,947

[22] Filed: Aug. 6, 1979

[51] Int. Cl.[3] ..... B30B 9/30

[52] U.S. Cl. ..... 100/224; 100/226; 100/240; 100/247; 100/255; 100/269 R

[58] Field of Search ..... 100/215, 218, 226, 255, 100/221, 224, 240, 269 R, 229 R, 246, 247, 251, 223, 222, 255

[56] References Cited

U.S. PATENT DOCUMENTS

| | | | |
|---|---|---|---|
| 179,091 | 6/1876 | Boomer | 100/224 |
| 258,134 | 5/1882 | Schenck | 100/224 X |
| 318,285 | 5/1885 | Parker | 100/224 |
| 772,472 | 10/1904 | Neill | 100/222 X |
| 2,176,543 | 10/1939 | Norton | 100/224 UX |
| 3,002,479 | 10/1961 | Johansen | 100/224 X |
| 3,749,003 | 7/1973 | Wilkes | 100/226 X |
| 3,752,060 | 8/1973 | Hubert | 100/224 X |
| 3,941,047 | 3/1976 | Orlando | 100/226 X |

FOREIGN PATENT DOCUMENTS

| | | | |
|---|---|---|---|
| 2208373 | 9/1973 | Fed. Rep. of Germany | 100/229 R |

*Primary Examiner*—Billy J. Wilhite

*Attorney, Agent, or Firm*—Jack M. Wiseman

[57] ABSTRACT

Apparatus for making modules in which material is deposited in an open-bottom rectangular bin. A tamping mechanism is mounted at the open top of the bin for compressing the material into a module. At each end of the bin 15 is a door that is pivotal about a horizontal axis at the upper section of the bin. While the doors are closed, the material is compressed into a module. The doors are alternately opened for the removal of modules through alternate ends of the bin. At each side of the bin are hydraulic jacks for raising and lowering the bin. While the bin is lowered, the material is compressed into a module. When the bin is raised, a module is removed from the bin. Forming the floor or base of the bin is a movable transfer table that travels over a rectilinear path through the ends of the bin. When a module is formed at one end of the table within the bin, the other end of the table is outside of the bin for the removal of a module. When a module is formed at the other end of the table within the bin, the one end of the table is outside of the bin for the removal of a module. Each end of the table travels only through the alternately opened adjacent end of the bin.

25 Claims, 19 Drawing Figures

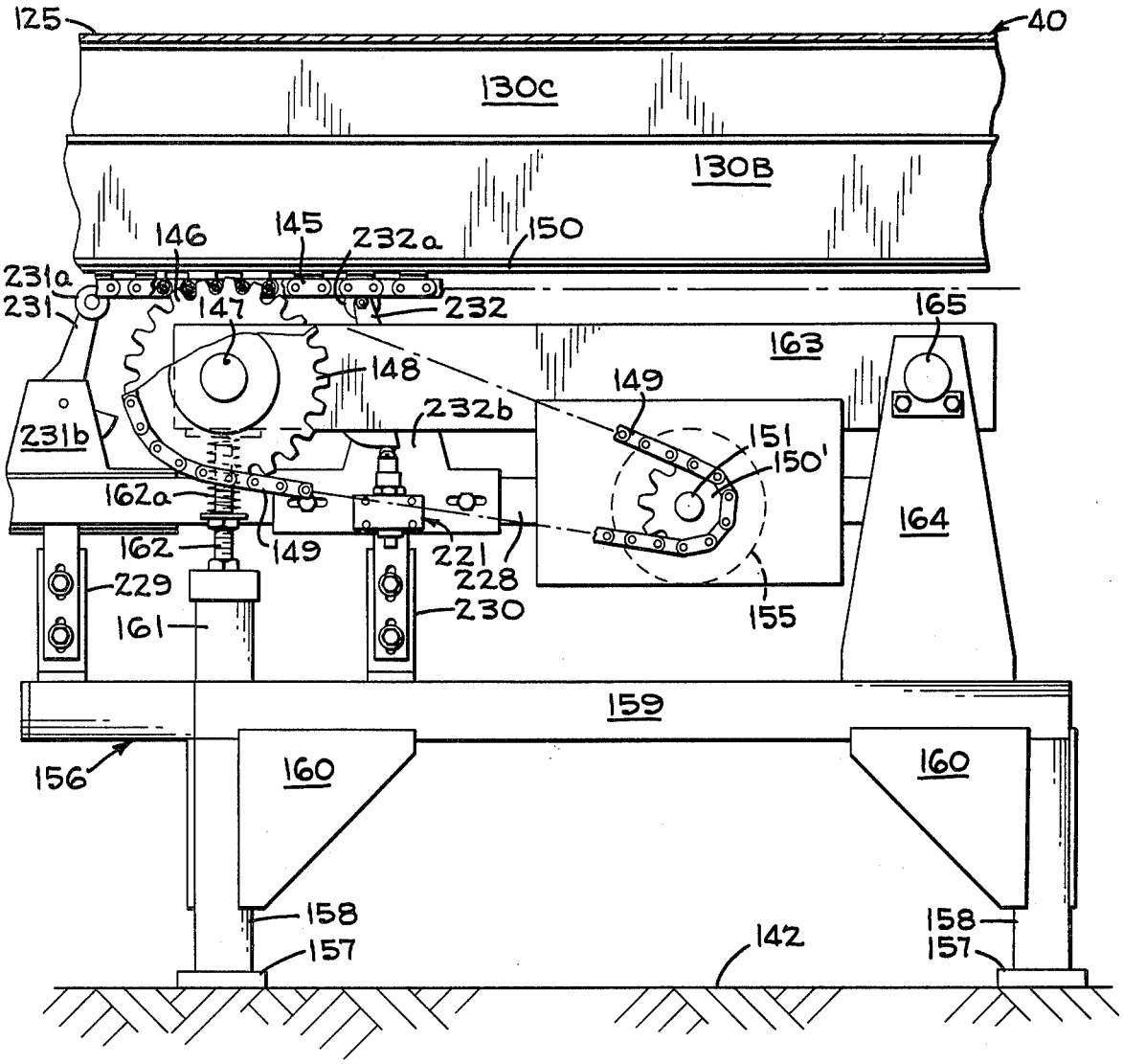
Fig-8
Fig-9
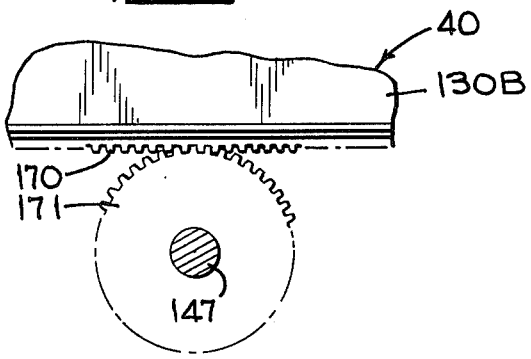

87
84
20
10
85
92
92
90
91
82
83
90
91
121
95
81
80
121
95
96
96
56c
97
56c
97
56
56
56a
56a
15
56b
56b
48
48
45
45
22
21
35
50
50
55
55

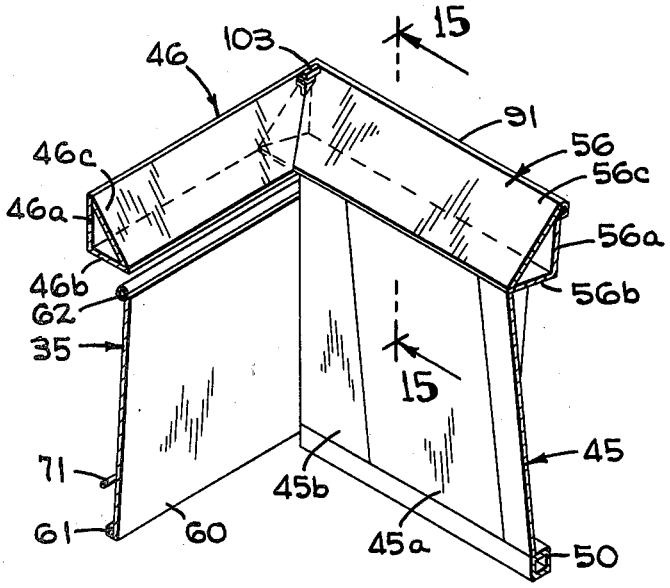
Fig_12
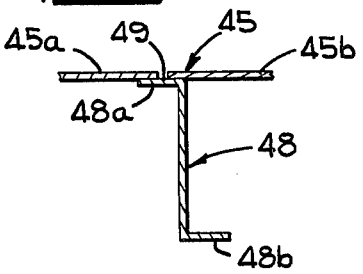
Fig_13
Fig_14
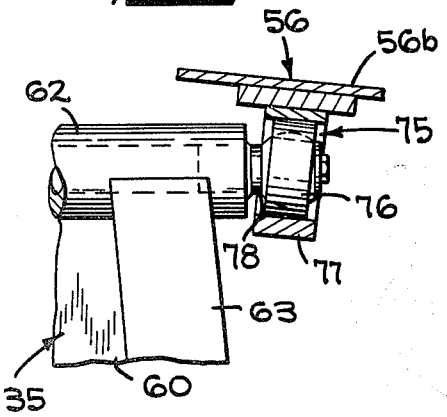
Fig_15
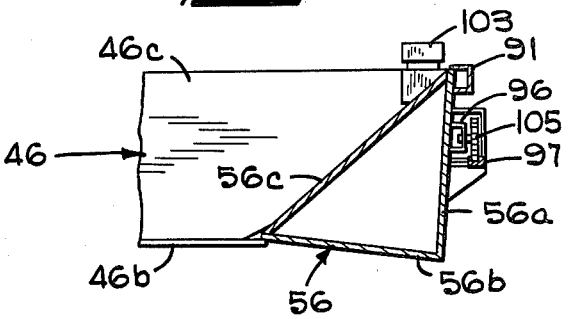

Fig-16
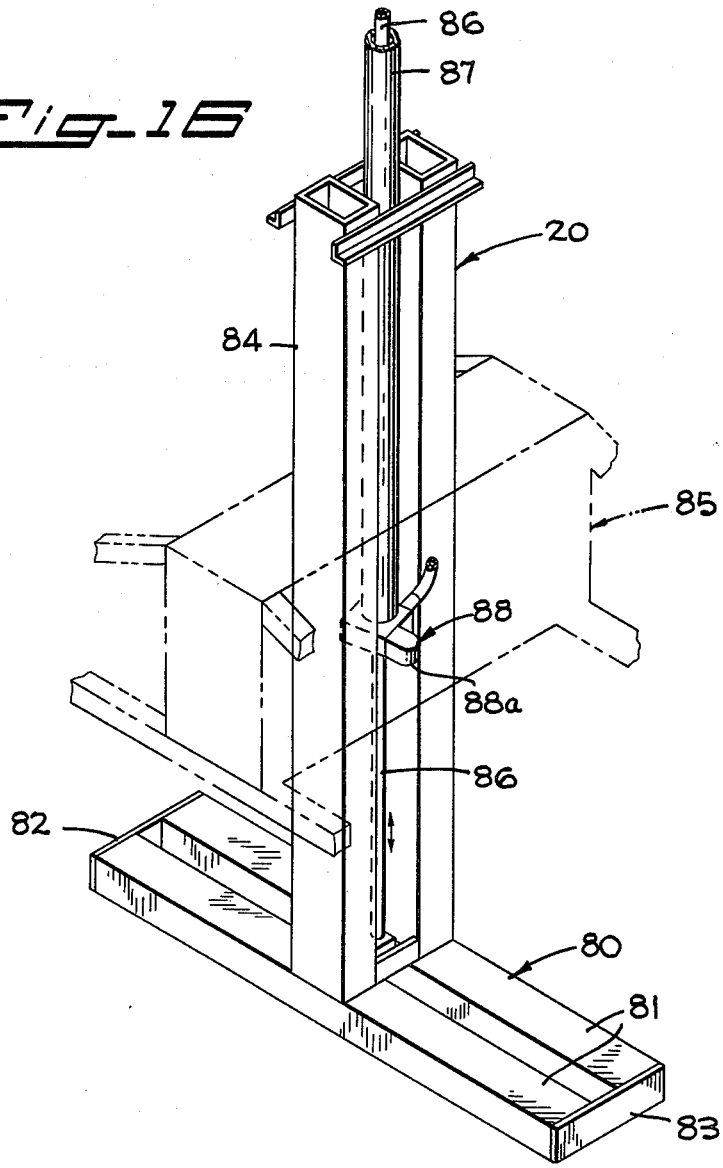
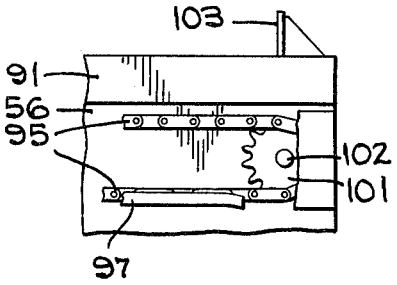
Fig-17

APPARATUS FOR MAKING MODULES

BACKGROUND OF THE INVENTION

The present invention relates in general to module builders, and more particularly to an apparatus for compacting modules on a transfer table.

In the patent to Wilkes et al., U.S. Pat. No. 3,749,003, issued on July 31, 1973, for Seed Cotton Handling Apparatus, there is disclosed a cotton module builder which formed large modules of cotton in the cotton fields. The patent to Orlando et al., No. 3,941,047, issued on Mar. 2, 1976, for Cotton Module Builder discloses a mobile cotton module builder with an open-bottom rectangular bin in which seed cotton was deposited. A compacting mechanism was mounted on the open top of the bin to compress the cotton into a module. A door was mounted on a horizontal axis above the bin through which the cotton module was removed from the bin. Hydraulic jacks raised the bin prior to removal of a module and lowered the bin prior to the compacting of the cotton into a module.

The patent to Hubert et al., U.S. Pat. No. 3,752,060, issued on Aug. 14, 1973, for Process In Double Platen Densifying Press discloses a single press and a transfer table on which material is pressed. The material is loaded on each end of the transfer table, then moved alternately into and out of the press rotation.

In the patent to Bromley, U.S. Pat. No. 369,582, issued on Sept. 6, 1887, for Baling Press there is disclosed a baling press for bale hay and for prizing tobacco. There is a common press and a transfer table on which material is pressed. There are boxes at each end of the transfer table in which material to be pressed is deposited. The transfer table is moved for alternately loading and unloading pressed material at each end of the transfer table.

Other patents of interest are

Boomer—U.S. Pat. No. 179,091

Johanson et al.—U.S. Pat. No. 3,002,479.

The module builders disclosed in the above cited patent to Wilkes et al. and the above cited patent to Orlando et al. were employed on the cotton turn-row. After the module was formed, the module builder was moved to another location for forming the next module. Thus, the module builder during field operations was moved to various locations in the field. During the periods of time the module builder was moved to the next location, it was not forming a module.

In order to increase the receiving capacity of seed cotton, a cotton module builder was located at the cotton gin. Trailers with seed cotton were brought to the module builder. Thereupon, the cotton was removed from the trailer and deposited into the bin of the module builder by suction pipes or by a dumping process. The module builder compacted the cotton into a module on a pallet. The pallets were placed on the floor or the base of the bin in succession on a roller conveyor. The builder formed a module on that pallet in succession and the pallets with the modules thereon were removed from the bin in succession. With this arrangement, the cotton gin incurred additional costs for the pallets and additional labor expenses for the handling of the pallets.

In another arrangement, the cotton module builder was located at the cotton gin in the gin yard storage area. Seed cotton was removed from a trailer and deposited into the cotton module builder through a transfer system mounted on a truck. The cotton module builder compacted the seed cotton into a cotton module. After the cotton module was formed, the module was removed for transfer into the cotton gin and the cotton module builder was moved to another location in the gin yard to form another cotton module. Thus, the cotton module builder was not building a module during periods of movement to the next location. The seed cotton transfer truck was also moved to the next location. The seed cotton grower was in doubt as to the location for his trailer carrying the seed cotton from the field.

SUMMARY OF THE INVENTION

Apparatus for making modules in which material is deposited into a bin and compacted into a module. Modules are formed in the bin in succession on successive sections of a transfer table disposed in succession at the base of the bin.

A feature of the present invention is to provide apparatus for making modules with a transfer table that has successive sections thereof disposed in a bin in which successive modules are formed and has successive sections thereof extending out of the bin for the removal of modules.

Another feature of the present invention is to provide apparatus for making modules in which a single bin and a single tamping mechanism is used with a transfer table having rectilinear movement.

Another feature of the present invention is to provide apparatus for making modules having a door at each end of the bin through which successive modules formed in the bin are alternately removed from the bin.

Another feature of the present invention is to provide apparatus for making modules having a door at each end of the bin through which successive modules formed in the bin are alternately removed from the bin and the use of hydraulic jacks to lift the bin for the removal of a module through one of the doors, and to lower the bin while the doors are closed and during the compacting of material into a module.

By virtue of the present invention, apparatus for making modules is provided that reduces the time of nonproductive use, thereby providing greater efficiency thereof in time use. In the present invention, the apparatus for making modules is located at one station as is the feed system depositing material in the apparatus for making modules. There is a minimum of lost production time, since a module is being built shortly after each section of the transfer table completes its travel to remove a module and the adjacent door is closed. Thus, the removal of a module and the forming of a succeeding module can be carried out simultaneously.

DESCRIPTION OF THE DRAWINGS

FIG. 8 is an enlarged vertical sectional view taken along line 8—8 of FIG. 7 to illustrate the drive arrangement for the transfer table employed in the apparatus shown in FIG. 1.

FIG. 9 is a fragmentary section showing a modified form of the drive arrangement for the transfer table employed in the apparatus shown in FIG. 1.

FIG. 12 is a perspective view of an interior corner of the apparatus for making modules illustrating a connection at one of the side and end triangular cross-sectional box beams.

FIG. 13 is an enlarged sectional view taken along line 13—13 of FIG. 1 to illustrate the structure of one of the web beams which brace the sides of the apparatus for making modules.

FIG. 14 is an enlarged detail view, partially in section, of one of the upper pivotal mountings for the doors at each end of the bin of the apparatus for making modules.

FIG. 15 is an enlarged section taken along line 15—15 of FIG. 12.

FIG. 16 is an isometric view of the compacting apparatus located atop of the module builder with the supporting structure therefor being shown in phantom lines.

FIG. 17 is an enlarged, fragmentary elevation view of the chain drive means for the compacting apparatus located at one corner of the bin with portions of the cover structure being broken away for purposes of clarity.

DESCRIPTION OF THE PREFERRED EMBODIMENT

Figure 1:
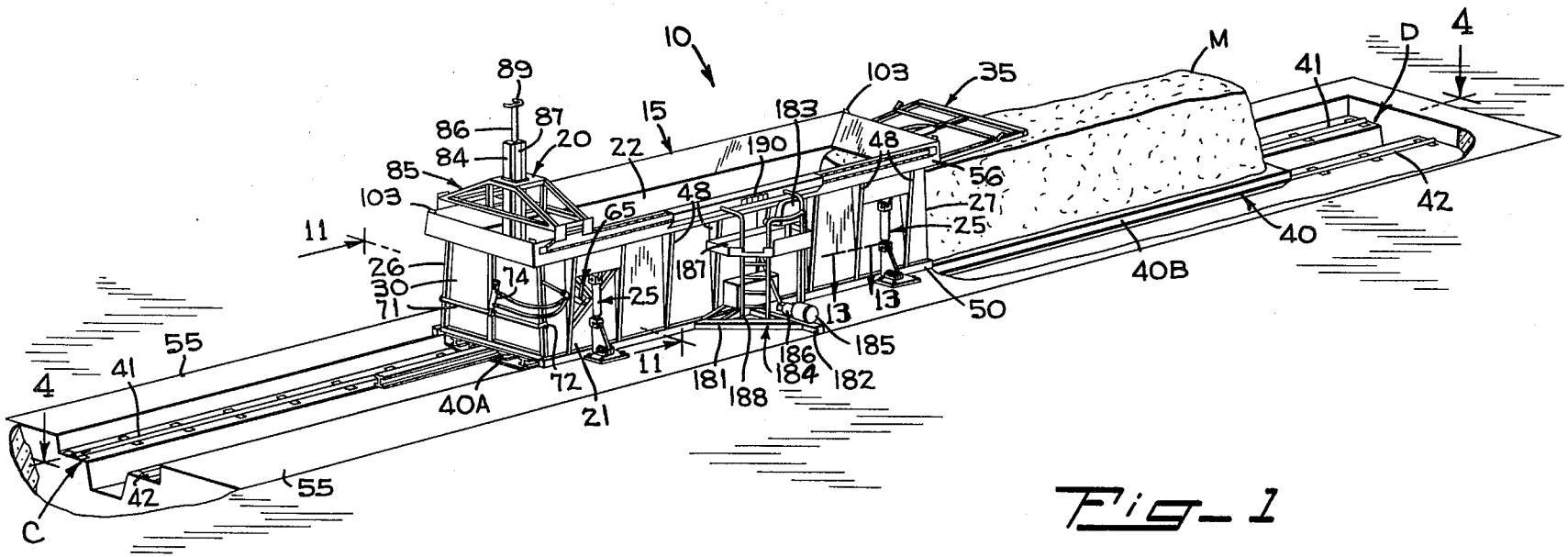
FIG. 1 is a perspective view of apparatus for making modules embodying the present invention.

Briefly, the apparatus for making modules 10 of the present invention comprises a bin 15 (FIG. 1) in which is deposited material, such as cotton, to be formed in a module M. It is to be understood that material other than cotton may be formed into modules. Mounted on the bin 15 is a tamping mechanism 20 for compacting the material into a module M. Along the sides 21 and 22 of the bin 15 are longitudinally spaced hydraulic jacks 25. The hydraulic jacks 25 serve to lower the bin 15 prior to the material deposited into the bin 15 being formed into a module M and raise the bin 15 prior to the module M being removed from the bin 15. At each end 26 and 27 of the bin 15 is a door 30 and 35, respectively, that pivots about a horizontal axis located at the top of the bin 15. The doors 30 and 35 are alternately opened and closed for the removal of successive modules M through the alternately opened ends 26 and 27 of the bin 15.

At the bottom of the bin 15 is a transfer table 40. The transfer table 40 may be considered to be divided into two sections, 40A and 40B. The sections 40A and 40B of the transfer table 40 are alternately disposed within the bin 15 so that successive modules M are alternately made on the sections 40A and 40B of the transfer table 40. Supporting the transfer table 40 for rectilinear movement are parallel tracks or rails 41 and 42. The tracks or rails 41 and 42 may be considered to be divided into two sections C and D.

Initially, the bin 15 is lowered and the doors 30 and 35 are closed. Section 40B of the transfer table 40 is disposed at the bottom of the bin 15 to form the base thereof and the section 40A of the transfer table 40A is disposed outside of the bin 15 and onto the section C of the tracks 41 and 42. Material is deposited into the bin 15 and is compacted by the tamping mechanism 20 to form a module M on the section 40B of the transfer table 40. While it is described herein that the module M is made on the section 40B of the transfer table 40, it is apparent that the module M can be made on a pallet that is supported by the section 40B of the transfer table 40.

Now, the bin 15 is raised by the hydraulic jacks 25 and the door 35 is opened. Thereupon, the section 40B of the transfer table 40 is moved to the section D of the tracks 40 and 41. The module M is thereby moved out of the bin 15 through the opened end 27 of the bin and the section 40A of the transfer table 40 is now disposed in the bin 15 to form the base thereof. The door 35 is thereupon closed and the bin 15 is lowered. Material is deposited into the bin 15 and the module M at the section D of the tracks 41 and 42 is moved to another station. Should the module M be made on a pallet, then the pallet and the module M may be transferred together to another station and a replacement pallet will then be placed on the section 40B of the transfer table 40.

The material deposited into the bin 15 is compacted into a module M on the section 40A of the transfer table 40. After the succeeding module M is made on the section 40A of the transfer table 40, the bin 15 is raised and the door 30 is opened. Now, the transfer table 40 is moved so that the section 40A of the transfer table 40 is advanced to the section C of the tracks 41 and 42 and the section 40B of the transfer table is moved into the bin 15 to form the base thereof. The succeeding module M is thereby moved through the opened end 26 of the bin 15 to be located at the section C of the tracks 41 and 42. The bin 15 is now lowered and the door 30 is closed. The module M at the section C of the tracks 41 and 42 is transferred to another station and the section 40B of the transfer table 40 is disposed in the bin 15 to form the base thereof. While the module M is described as formed on the section 40A of the transfer table 40, it is to be understood that the module M could be formed on a pallet supported by the section 40A of the transfer table 40. When the module M is removed at the section C of the tracks 41 and 42 for transfer to another station, it may be removed with the pallet and another pallet may then be placed on the section 40A of the transfer table 40.

The bin 15 is a generally rectangular, open-top frame structure. The major portion of each side frame 21 and 22 of the bin 15 includes a wall 45 (FIG. 11), which walls 45 slope toward one another from bottom to top so that the walls 45 are farther apart at the bottom of the bin 15 than the top of the bin 15.

Figure 2:
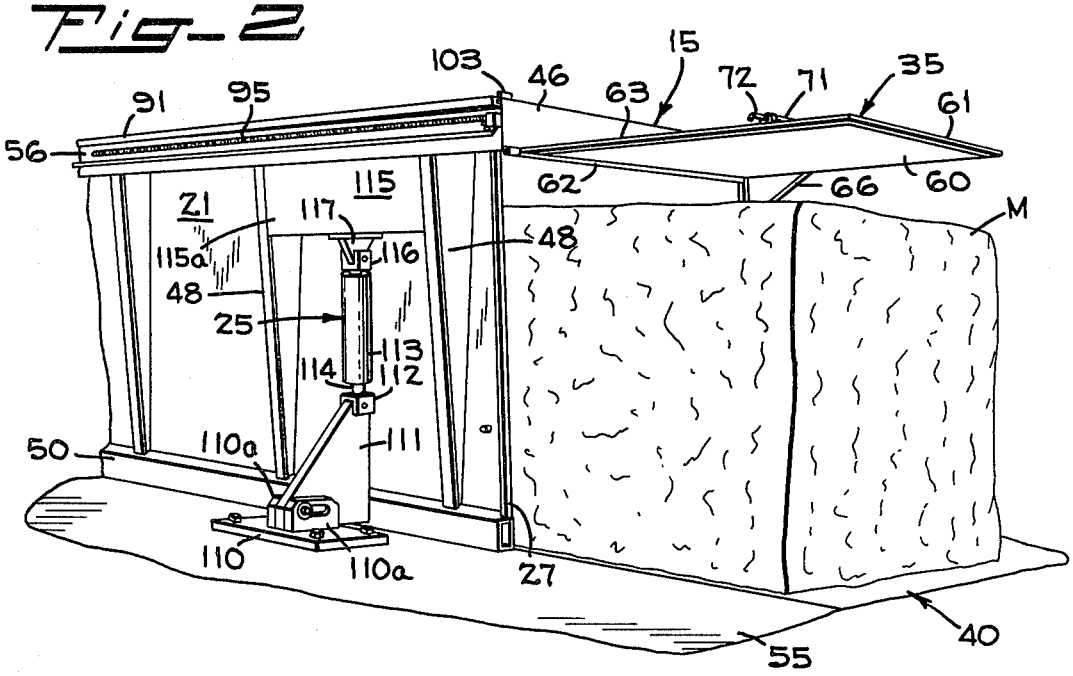
FIG. 2 is an enlarged fragmentary perspective view of the apparatus for making modules shown in FIG. 1 taken from one end thereof and illustrating a module being removed from the apparatus.
Figure 3:
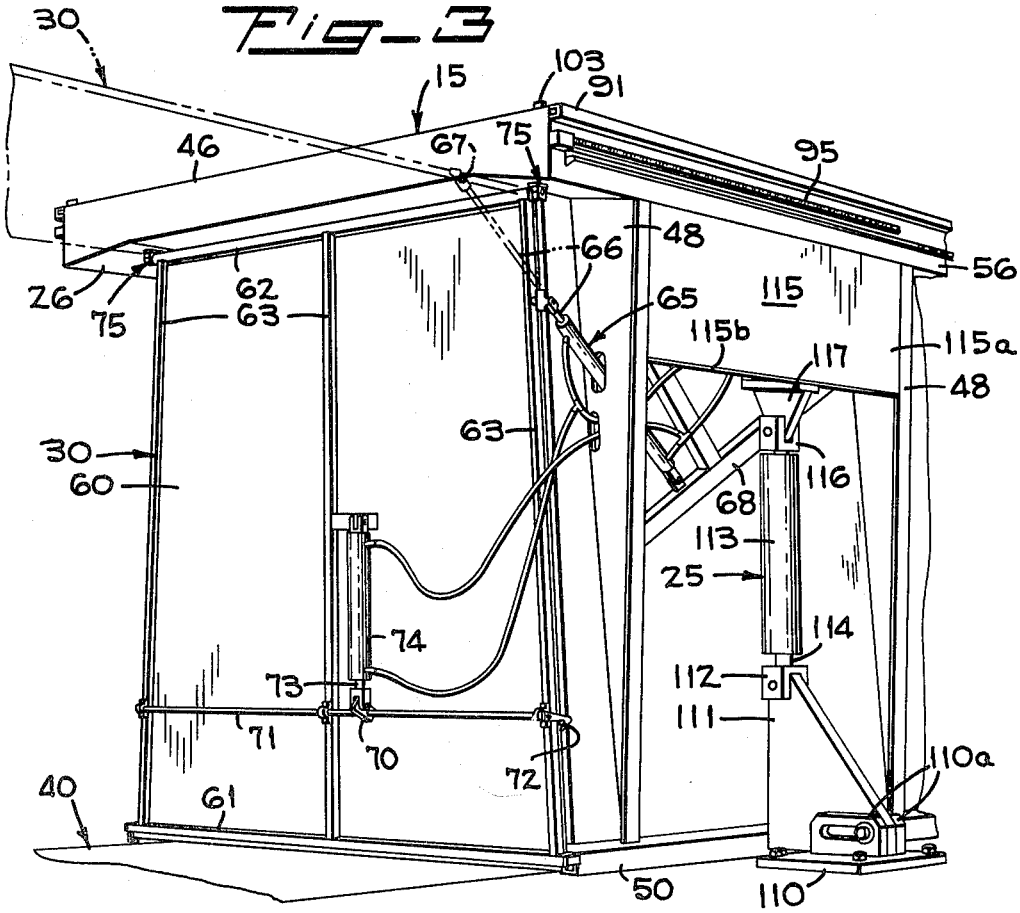
FIG. 3 is an enlarged fragmentary perspective view of the apparatus for making modules shown in FIG. 1 taken from another end thereof.
Figure 4:
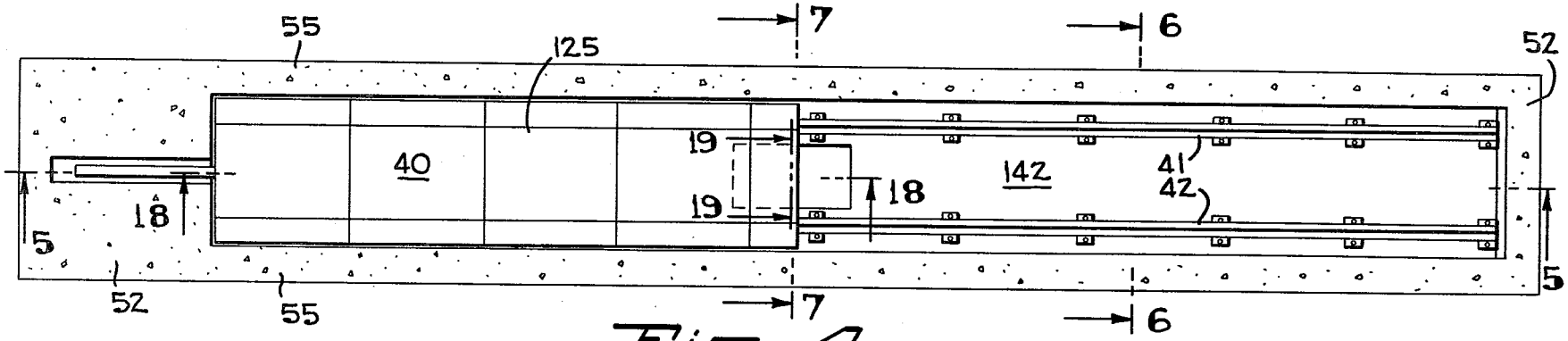
FIG. 4 is a plan view taken along line 4—4 of FIG. 1 to illustrate a transfer table, tracks support therefor, and pit employed in the apparatus shown in FIG. 1.
Figure 5:
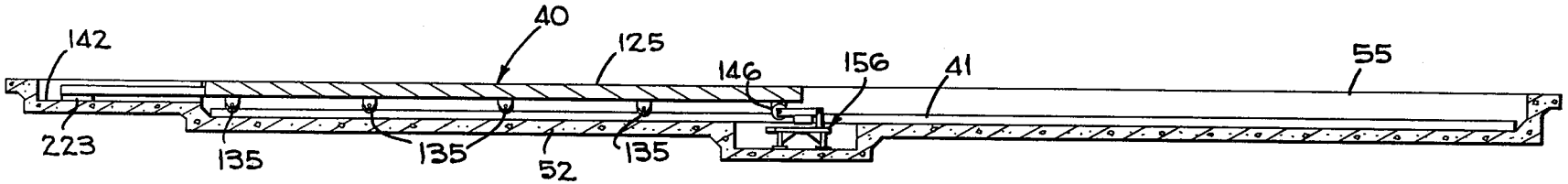
FIG. 5 is a vertical section taken along line 5—5 of FIG. 4 to illustrate the transfer table and pit employed in the apparatus shown in FIG. 1.

The side walls 45 are interconnected at one end of the bin 15 by a door 30 and at another end of the bin 15 by a door 35 (FIGS. 2 and 3). The doors 30 and 35 are mounted for pivotal movement at the respective upper edges thereof. A closed box beam 46 with a triangular cross-sectional area serves as a header plate above the door (FIG. 12). The inside surfaces of the opposed walls 45 are preferably smooth so as not to catch and snag material deposited into the bin 15. The walls 45 should be constructed of material, such as sheet metal, with stiffness sufficient to resist the lateral forces exerted upon the side walls 45 by the tamped material.

Each side frame structure 21 and 22 also contains solid web beams 48 (FIG. 2) extending outwardly of and laterally of the side walls 45 and having inner and outer flanges **48*a* and 48*b*, respectively (FIG. 13), for further laterally strengthening the side walls 45. The side walls 45 are formed by a plurality of separate panels (FIG. 13) in which contiguous panels are secured together by the adjacent beam 48. The inner flange 48*a* of the beam 48 is welded onto each of the adjacent panels 45*a* and 45*b* so as to leave a small gap 49** therebetween (approximately one-half inch).

Longitudinal runners 50 (FIGS. 1 and 11) with rectangular cross-sectional areas are located at the bottom of each of the side walls 45 and are welded to the lower edges of the side walls 45 and the web beams 48 to further secure the web beams 48 and the side walls 45 together. The longitudinal runners 50 overlie the adjacent edges of a track platform 55 and will contact the track platform when the bin 15 is in the lowered position. It is within the contemplation of the present invention that the runners 50 may seat on the transfer table 40 when the bin 15 is in the lowered position.

Secured to the upper portion of each of the side walls 45 is a closed box beam 56 with a triangular cross-sectional area that is composed of three interconnected walls **56*a*, 56*b* and 56*c* (FIGS. 11 and 12) running the length of the bin 15. The upper portion of the inner side wall 56*c* of the box beam 56 is sloped inwardly to act, in effect, as a funnel in directing the material deposited from above, into the bin 15 or the compacting area of the module 10. The web beam 48 is welded to the underside of the bottom wall 56*c* of the box beam 56 to further secure the web beam 48, the box beam 56 and the side wall 45 together. The closed triangular beam 56 serves to increase the torsional resistance of the entire side wall 45 and also to stiffen the bin 15 when either the door 30 or the door 35 is opened, so as to prevent binding of either door 30 or door 35**.

The torsional resistance of the bin 15 provided by the box beams 56 is proportional to the total enclosed cross-sectional area of these beams. The torsional and bending loads are transmitted from the side wall beams 56 to the end wall beams 46 through a preferred corner design, and the cracking or buckling of the bin 15 at the corners of the side wall beams 56 is prevented. A more detailed analysis of the foregoing structure may be found in the patent to Orlando et al., U.S. Pat. No. 3,941,047, issued on Mar. 12, 1976, for Cotton Module Builder.

The length of the transfer table 40 is at least twice the length of the longitudinal runners 50 (FIG. 1). The width of the transfer table 40 is slightly less than the distance between the longitudinal runners 50, when the longitudinal runners seat on the platform 55. When the longitudinal runners 50 seat on the transfer table 40, then the width of the transfer table 40 is slightly greater than the distance between the outer edges of the longitudinal runners 50. Thus, the transfer table 40 is at least twice the length of the base of the bin 15 and the width of the transfer table 40 is slightly less or slightly greater than the inner transverse dimension of the bin 15 at the base thereof, depending on the supporting structure for the longitudinal runners 50.

If pallets were to be employed, each pallet would have a width slightly less than the width of the bin 15 at the base thereof and would have a length at least as long as the bin 15 along the base thereof. Each door 30 and 35 includes a vertical panel 60 bounded by and welded to a lateral runner 61 along the lower edge thereof and a torsion tube 62 along the top edge thereof (FIGS. 2 and 3). The panel 60 is welded to spaced vertical braces 63 for additional stiffness and structural integrity. In the exemplary embodiments, the tube 62 is a thick-walled cylindrical tube which functions as a pivot for the adjacent door and a torsion tube to support a portion of the door and to minimize door sag when the door is in the opened position. An hydraulic jack 65 for each door includes a piston rod 66 which is attached to a rotatable connection 67 at one of the upper side edges of the door (FIG. 3). The hydraulic jack 65 is mounted upon a brace 68 attached to the adjacent side wall 45. The hydraulic jack 65 serves to raise and lower its adjacent door for enabling a completed module M to be removed by the transfer table 40 from the bin 15.

Through the use of the torsion bar 62, which can apply a torsional force to support half of the door, only one hydraulic jack 65 is required for each door rather than an hydraulic jack on each side of a door. This results in simplification of the door opening and closing operations, as it does not require the coordinated operation of two such hydraulic jacks. In its closed position, each door is secured by a leverage bar 70, which is attached to a rod 71 that extends across the width of the adjacent door and is provided at its ends with a pair of latches 72. The rod 71 is mounted for rotation, as shown in FIG. 3, and the latches 72 are arranged to engage pins on the adjacent side wall structures. The leverage bar 70 is actuated by a piston 73 of a fluid cylinder 74. The unlatching of the door through the action of the piston 73 occurs prior to the operation of the hydraulic jack 65 opening the associated door. The latching of the door through the piston 73 occurs after the operation of the hydraulic jack 65 closing the associated door.

In FIG. 14 is illustrated one of the pivotal mountings 75 for the doors 30 and 35. The pivotal mounting 75 comprises a compensating bushing 76 hung in a frame 77 from the underside of the bottom wall **56*b* of the overlying box beam 46 (FIG. 12). The bushing 76 rotatably mounts a small shaft 78 (FIG. 14) which is rigidly secured within the torsion tube 62. The pivotal mounting device for rotatably mounting each end of each torsion tube 62 for each door 30 and 35** is substantially identically constructed.

Above each door 30 and 35, the bin 15 is formed with the closed box beam 46. The inclined wall **46*c* (FIGS. 12 and 15) of the box beam 46 serves as the upper portion of the interior end walls, and the rear wall 46*a* of the box beam 46 serves as a header plate over the adjacent door. The bottom wall 46b of the box beam 46** lies in a generally horizontal plane.

The bottom wall 56b of the box beam 56 is slightly inclined (approximately 5°) to the horizontal, so that the inner corner of the beam 56 rests upon and is welded to the bottom wall 46b of the box beam 46 at each end of the bin 15. The weld line at this junction extends inwardly across the width of the bottom wall 46c of the beam 46, which, in the preferred embodiment, is approximately 16–20 inches. The side walls 56a and 46a of the box beams 56 and 46 are welded together on their (approximately vertical) line of intersection. The box beams 56 and 46 are thus secured together and also secured to the remainder of the side frame structures 45 so as to increase torsional resistance of the bin 15 when a door 30 or 35 is open.

Figure 11:
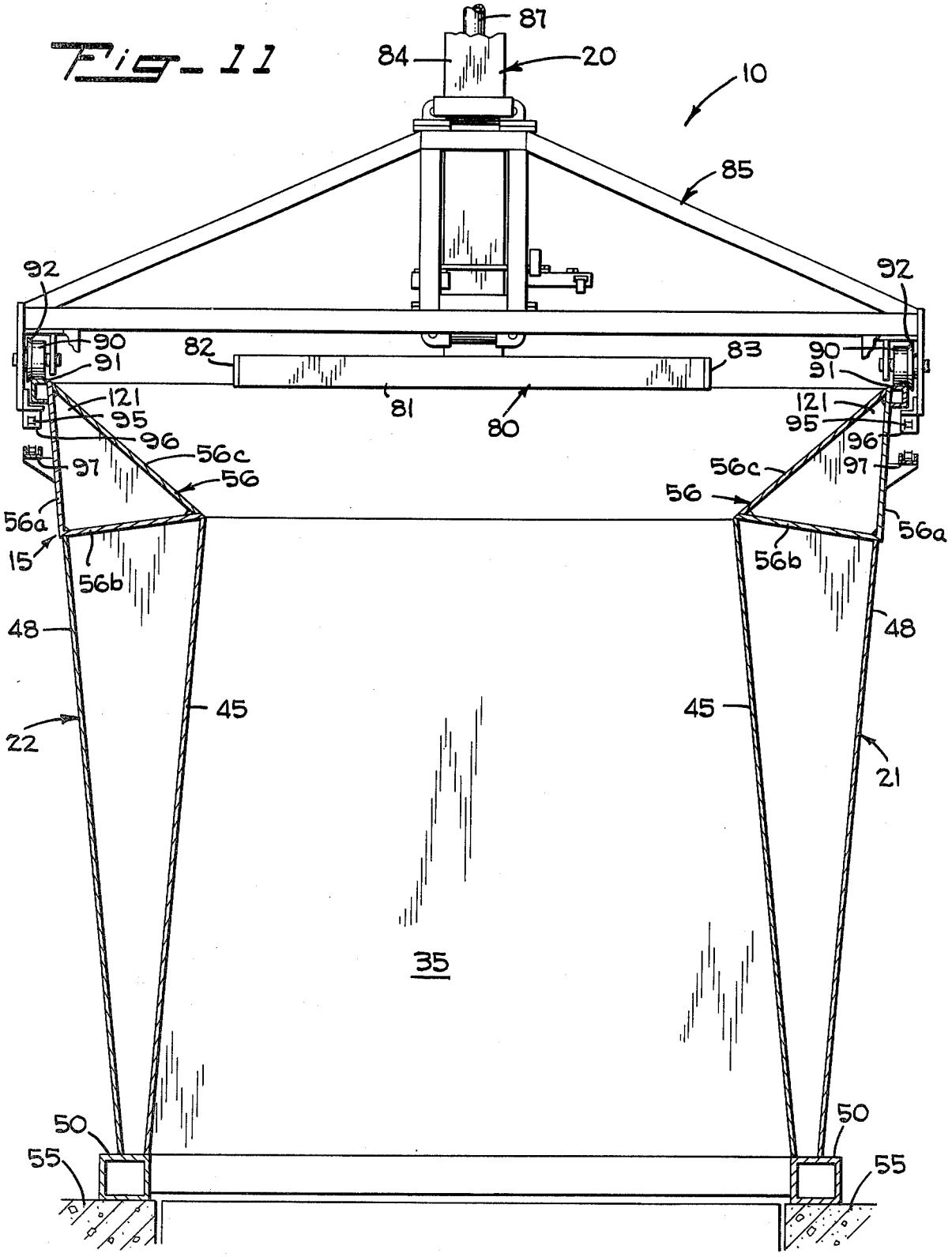
FIG. 11 is an enlarged vertical sectional view taken along line 11—11 of FIG. 1 looking along the longitudinal axis of the apparatus for making modules.

The tamping mechanism 20 is a conventional apparatus and is shown schematically in FIGS. 11 and 16. The compacting face of the tamping mechanism 20 is provided by a platen 80 formed of two tubes 81, which are held in parallel alignment and capped at each end by plates 82 and 83. The width of the end plates 82 and 83 may be in the order of fourteen to eighteen inches and the width of the tubes 81 is chosen to produce the desired tamping force. The tamping platen 80 is supported for vertical travel by means of a rectangular frame 84 which is guided by roller bearings within an A-frame structure 85 that is mounted atop of the bin 15.

The tamping platen 80 is raised and lowered by hydraulic means acting through a vertically positioned rod 86 attached to a piston within a vertically positioned hydraulic cylinder 87 that is mounted for relative sliding movement within the frame 84 (FIG. 16) and has a length corresponding to the vertical distance of travel (approximately six feet) of the platen 80. The lower end of the cylinder 87 is provided with a housing 88 for the inflow and outflow of the hydraulic fluid, and the housing 88 is provided with laterally extending ears 88a (only one being shown in FIG. 16) for releasable clamping engagement with structure fixed to the A-frame structure 85. The upper end of the cylinder 87 is provided with a vertically extending fitting 89 (FIG. 1) so that the hydraulic line connection will not be forced into the frame 84 when the platen 83 is raised to its full elevated position (FIG. 11).

The supporting A-frame 85 is provided with four wheels 90 which move longitudinally along two rails 91 (two wheels on each rail) mounted at the top outer edge of the side box beams 56 of the bin 15 (FIG. 11). The wheels 90 may have an outer bevel 92 (FIG. 11) of increased radius to assist the wheels 90 to stay on the rails 91. The wheels 90 may be metallic, as is conventional, or they may be solid rubber to reduce vibration and noise when the tamping mechanism 20 is in use.

Figure 10:
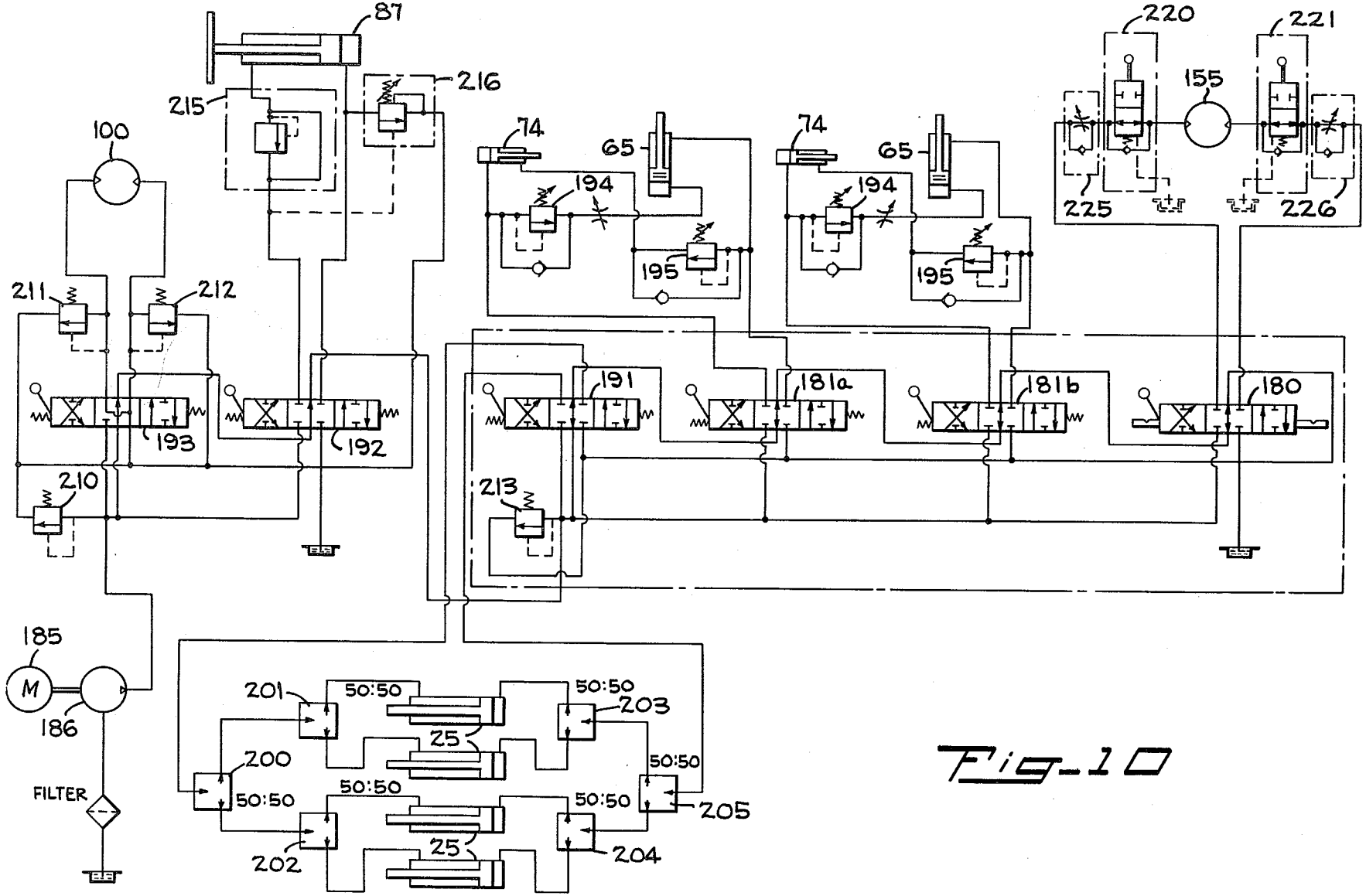
FIG. 10 is a schematic diagram of an hydraulic system employed in the apparatus shown in FIG. 1.

An endless chain 95 is attached to brackets 96 (FIG. 11) at each side of the A-frame structure 85. Each chain 95 has an upper run (to which the A-frame 85 is attached) for moving the tamping mechanism 20 longitudinally along the open top of the bin 15 and a lower run carried by a fixed track 97 (FIG. 14). The chains are powered by a reversible motor 100 (FIG. 10). The drive motor 100 provides power for a drive sprocket 101 (FIG. 17) at one end of each chain 95 by means of a laterally extending drive shaft 102. As the drive shaft 102 rotates, the sprockets 101 are turned to drive the chains 95 and move the tamping mechanism 20 along a rectilinear path forward and backward along the rails 91. The wheels 90 which support the tamping mechanism 20 are prevented from continuing beyond the ends of the rails 91 by bumpers 103 mounted at each end of each rail 91 (FIG. 1). At the other end of the bin 15, each chain 95 is mounted by means of an idler sprocket 105 (FIG. 15).

For raising and lowering the bin 15, the hydraulic jacks 25 are provided (FIGS. 1–3). There are two hydraulic jacks 25 along each side of the bin 15. Each hydraulic jack 25 comprises a base plate 110 that is anchored to the adjacent platform 55 by bolts. Welded to the base plate 110 are parallel members 110a to which an upright plate 111 is bolted. The hydraulic jacks 25 are provided with cylinders 113. Each cylinder 113 is pivotally attached by a clevis 116 to the central portion of a gusset 115 through an ear 117. The ear 117 is welded to the underside of the gusset 115. A piston rod 114 is received by each cylinder 113 for rectilinear movement. Each piston rod 114 is pivotally attached to the upright member 111 through a clevis 112.

Each gusset 115 comprises a vertically extending outer wall 115a, a laterally extending short wall 115b and an inclined wall with the ear 117 being welded to the underside of the lower wall 115b. The upper edges of the gusset walls are welded to the lower wall 56b of the overlying box beam 56. The gussets 115 span the distance between successive web beams 48. A reinforcing plate is enclosed within the walls of each of the gussets 115 in the plane of the associated jack 25 to strengthen the gusset 115 at its point of highest stress. Additionally, two separate and spaced plates 121 (FIG. 11) are enclosed within and welded to the interior walls of the box beams 56 forming the upper side wall structures of the bin 15. The plates 121 are vertically oriented and are located just above the successive web beams 48 having the gusset 115 disposed therebetween in order to strengthen the bin structure at these high stress points. Additionally, the reinforcing plates 121 may be enclosed within the box beams 56 at the points along the length of the bin 15 where extra strengthening is desirable.

A more detailed analysis of various structural elements of the module builder may be found in the patent to Orlando et al., U.S. Pat. No. 3,941,047, issued on Mar. 12, 1976, for Cotton Module Builder.

Figure 6:
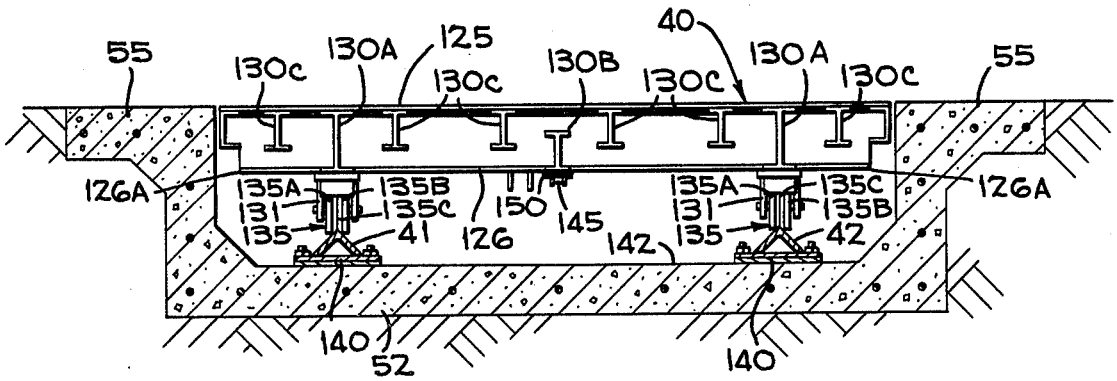
FIG. 6 is an enlarged vertical section taken along line 6—6 of FIG. 4 to illustrate the transfer table and track support therefor employed in the apparatus shown in FIG. 1.

The transfer table 40 (FIGS. 4–8) comprises a horizontal treaded plate 125. Below the plate 125 are longitudinally extending and transversely spaced I-beams 130A, 130B and 130C. The I-beams 130A have suspended therefrom transversely spaced brackets 131, which journal for rotation wheels 135. The I-beams 126 are longitudinally spaced and extend in the transverse direction. The I-beams 130A extend the full length of the platform 40. The I-beams 130B extend beyond the ends of the platform 40. The I-beams 130C are shorter I-beams and extend longitudinally between the transverse beams 126. Out rigger beams 126A are disposed at each end of the I-beams 126 outward of the adjacent I-beams 130A. Thus, a matrix or web of I-beams are incorporated in the transfer table 40. Each wheel 135 includes a pair of discs 135a and 135b (FIGS. 6 and 7) with inwardly tapered walls to form a groove 135c along the circumference thereof. The circumferential grooves 135c receive the rails 41 and 42, respectively. The rails 41 and 42 are formed with angle plates so that the spaces thereof are received by the grooves 135c respectively. The legs of the angle plates forming the rails 41 and 42 are welded to a pad 140. In turn, the pads 140 are anchored by nuts and bolts 141 to concrete 52 defining a pit 142.

Figure 7:
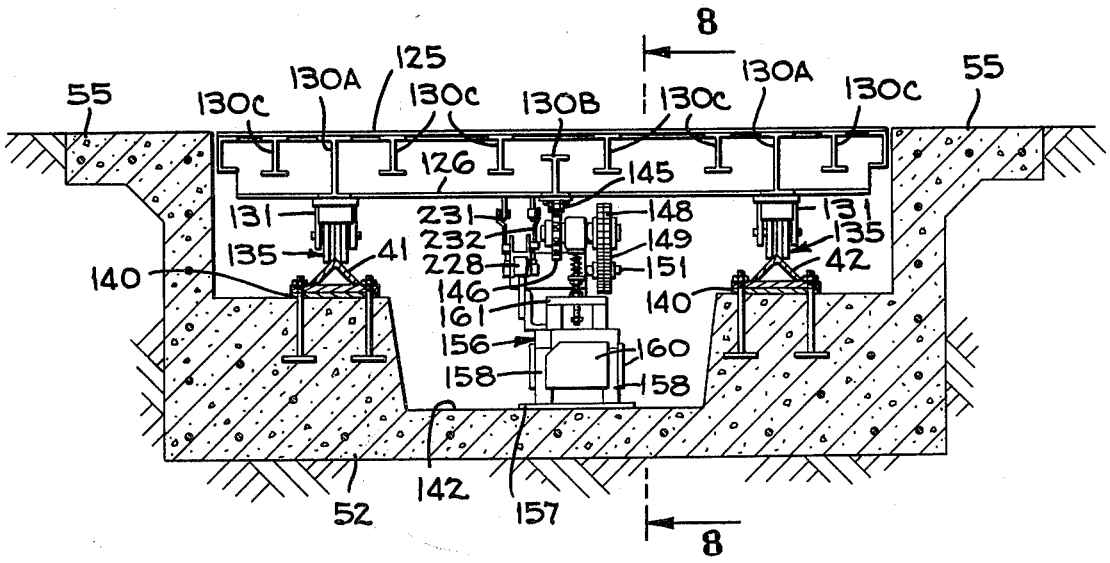
FIG. 7 is an enlarged vertical section taken along line 7—7 of FIG. 4 to illustrate a drive arrangement for the transfer table employed in the apparatus shown in FIG. 1.

Mounted on the bottom wall of the I-beam 130B intermediate the sides thereof and preferably centrally between the sides thereof is a longitudinally extending chain 145 (FIGS. 7 and 8). The chain 145 is fixed to the bottom wall of the I-beam 130B through a channel member 150 that is welded to the I-beam 130B. The chain 145 extends substantially along the entire length of the transfer table 40. Below the chain 145 is disposed a table drive sprocket 146 (FIGS. 7, 8 and 18) that is fixed to a shaft 147 (FIG. 8) to be driven thereby. For driving the shaft 147, a sprocket 148 is fixed thereto. An endless chain 149 is trained around the sprocket 148 for imparting rotation thereto. The chain 149 is also trained around a drive sprocket 150'. Rotation of the sprocket 150' rotates the sprocket 148, which in turn rotates the sprocket 146. The sprocket 150' is fixed to a drive shaft 151 of a reversible hydraulic motor 155.

The hydraulic motor 155 (FIG. 8) is mounted in the pit 142 through a suitable stationary motor mount 156. In the exemplary embodiment, the stationary motor mount 156 (FIGS. 7, 8 and 18) includes pads 157 that are fixedly secured to the bottom wall of the pit 142. Upright tubes 158 are fixed to the pads 157. Fixed to the upright tubes 158 are parallel horizontal members 159 (FIG. 18) of equal height. Gussets 160 are fixed to the upright tubes 158 and the horizontal members 159. A plate 164 (FIG. 8) extends from the horizontal members 159. An upright U-shaped support 161 extends from the horizontal members 159 with a bolt 162. A support bar 163 is supported by the bolt 162 and pivotally supported by the plates 164. The bolt 162 is surrounded by a spring 162*a* to provide a yieldable support for the support bar 163. The motor 155 and the drive arrangement including the sprockets 146, 148 and 150', and the chain 149, are supported by the support bar 163. The support bar 163 is connected to the plates 164 by a shaft 165 to allow the support bar 163 a yieldable, pivotal movement through the spring 162*a*.

In a modified drive arrangement (FIG. 9), a rack 170 is fixed to the I-beam 130B of the transfer table 40 instead of the chain 145 being fixed to the I-beam 130B. A pinion 171 engages the rack 170 to impart rectilinear movement to the transfer table 40. The pinion 171 is driven through a reversible hydraulic motor in the manner previously described for driving the sprocket 146.

Mounted on the bin 15 (FIG. 1) for movement therewith is a control platform 184 which comprises a triangular frame 181 fixed to the runner 50 of the side wall 45. The control platform 184 overlies the concrete platform 55 and is disposed thereabove. A transverse member 182 is fixed to both the runner 50 and the triangular frame 181 at the apex of the triangle. On the member 182 is mounted a suitable power source 185, such as a gasoline engine, a diesel engine, or electric motor, which drives an hydraulic pump 186. The hydraulic pump 186 provides fluid under pressure through suitable hydraulic hoses. The hydraulic pump 186 provides fluid under pressure to operate the transfer table drive motor 155; the cylinders 65 for raising and lowering the doors 30 and 35, respectively; the hydraulic jacks 25 for raising and lowering the bin 15; the cylinder 87 for the tamping mechanism 20; the reversible motor 100 for driving the tamping mechanism 20 along the top of the bin 15; and the cylinders 74 for locking and unlocking the doors 30 and 35, respectively.

Above the triangular frame 181 is mounted an operator's platform 187. The operator's platform is fixed to the adjacent beams 48 of the frame structure 21. A ladder 188 extends from the frame 181 to the platform 187. An operator's chair 183 is mounted on the platform 187. Fixed to the beam 56 and partially enclosing the tamping mechanism chain 95 is a control panel 190 from which the operator can control the operation of the tamping mechanism 20; the cylinders 65 for raising and lowering the doors, respectively; the hydraulic jacks 96 for raising and lowering the bin 15; the reversible motor 100 for controlling the longitudinal movement of the tamping mechanism 20; the reversible hydraulic motor 155 for manually controlling the rectilinear movement of the transfer table 40; and the cylinders 74 for locking and unlocking the doors 30 and 35, respectively. The pump 186 through hoses conducting fluid under pressure provides the power for the various hydraulic mechanisms and the reversible motors.

In FIG. 10 is shown a manually operated control valve 180 for controlling the operation of the reversible motor 155 for the transfer table 40. The cylinders 65 and 74 for the doors 30 and 35 are controlled respectively by manually operated control valves 181*a* and 181*b*. For controlling the simultaneous operation of the hydraulic jacks 25 to raise and lower the bin 15, a manually operated control valve 191 is provided. A manually operated control valve 192 is shown in FIG. 10 to control the operation of the cylinder 87 for the tamping mechanism 20. The carriage drive for the tamping mechanism for imparting longitudinal movement thereto is controlled by a manually operated control valve 193, which controls the operation of the reversible motor 100.

The power source 185, such as a gasoline engine, diesel engine, or electric motor, drives the hydraulic pump 186. The hydraulic pump 186 provides fluid under pressure through suitable hydraulic hoses for the operation of the various hydraulic devices and apparatus employed in the module builder 10.

The door latch cylinders 74 for the doors 30 and 35, respectively, are operated in sequence with their associated door lift and lower cylinders 65 for the doors 30 and 35, respectively. Toward this end, sequence valves 194 and 195 are connected to the adjacent latch cylinder 74 and the adjacent door lift and lower cylinder 65. The operation of the cylinders 65 and 74 for the door 30 is controlled by the manually operated control valve 181*a* and the operation of the cylinders 65 and 74 for the door 35 is controlled by the manually operated control valve 181*b*. When the control valve 181*a* is operated for one mode, the cylinder 74 causes the unlatching of the door 30 and subsequently the cylinder 65 for the door 30 raises the door 30. When the control valve 181*a* is operated in another mode, the cylinder 65 for the door 30 lowers the door 30 and the cylinder 74 causes the latching of the door 30. In a similar manner, operating the control valve 181*b* in one mode activates the cylinder 74 for the door 35 to first unlatch the door 35 and subsequently activates the cylinder 65 for the door 35 to lift the door 35. Operating the control valve 181*b* in another mode causes the cylinder 65 for the door 35 to lower the door 35 and subsequently causes the cylinder 74 for the door 35 to latch the door 35.

Communicating with the cylinders 25 for raising and lowering the bin 15 are fluid dividers 200–205, which are arranged for the cylinders 25 to operate simultaneously in response to the operation of the manually operated control valve 191. Conventional pressure relief valves 210–212 communicate with the carriage drive fluid motor 100 for the tamping mechanism 20. Interconnecting the tamper cylinder 87 and the manually operated control valve 192 is a counterbalance valve 215, which serves to apply a back fluid pressure to the tamper cylinder 87 to prevent the lowering of the compacting platen 81 when there is an absence of cotton in the bin 15 to be compacted. Also, it prevents the platen 81 from being lowered too rapidly. In order for the platen 81 to be lowered, a back fluid pressure of 400 psi must be present. Thus, the cylinder 87 must sense a back fluid pressure of 400 psi for the platen 81 to be lowered. Communicating with the cylinder 87 and the manually operated control valve 192 is an excess flow valve 216 which provides a path for the flow of excess fluid between the control valve 192 and the cylinder 87. A pressure relief valve 213 communicates with the valves 191, 181*a*, 181*b* and 180.

Figure 18:
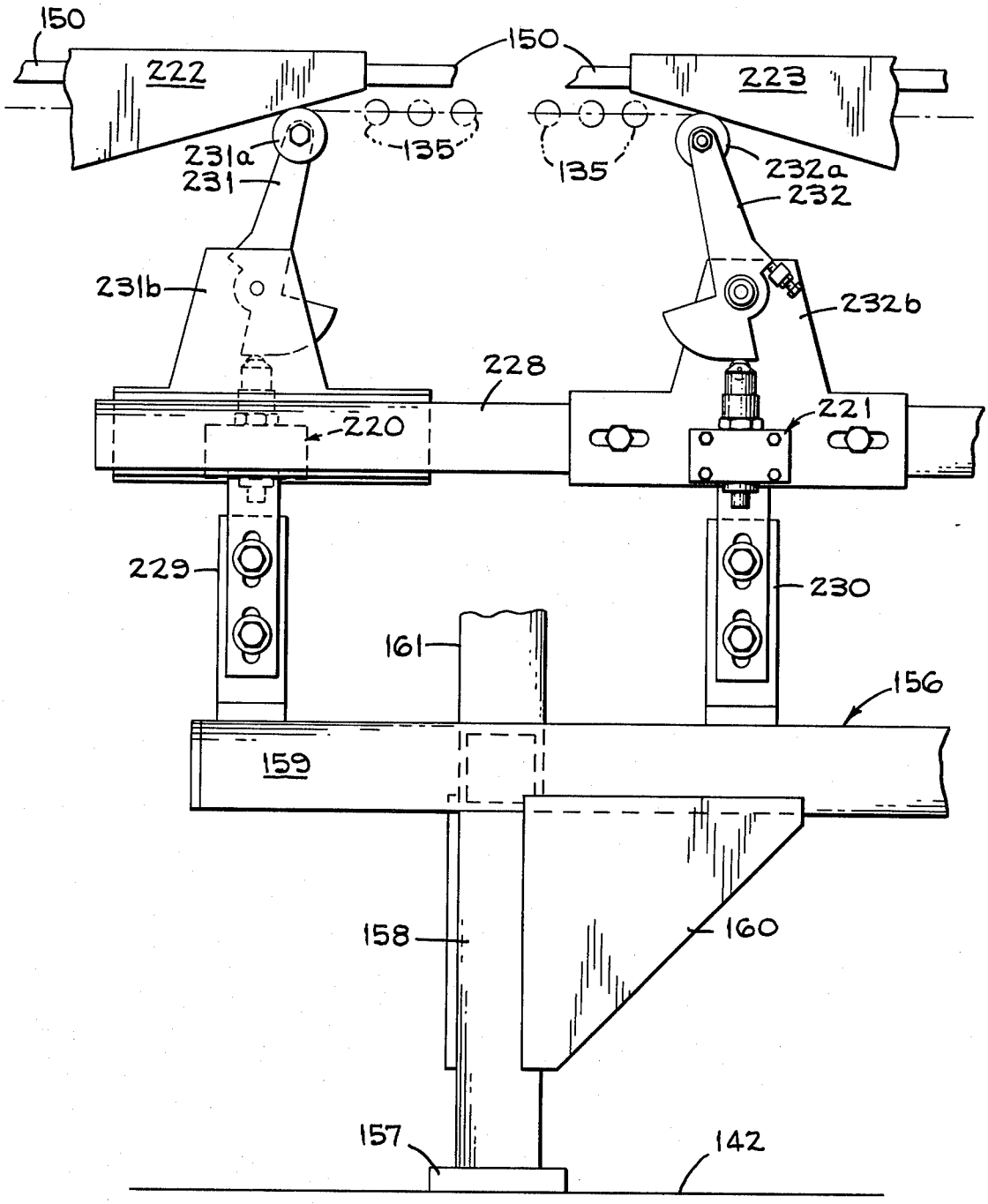
FIG. 18 is an enlarged fragmentary section view taken along line 18—18 of FIG. 4 to illustrate the cam and deceleration valve arrangement for stopping the transfer table at predetermined locations.
Figure 19:
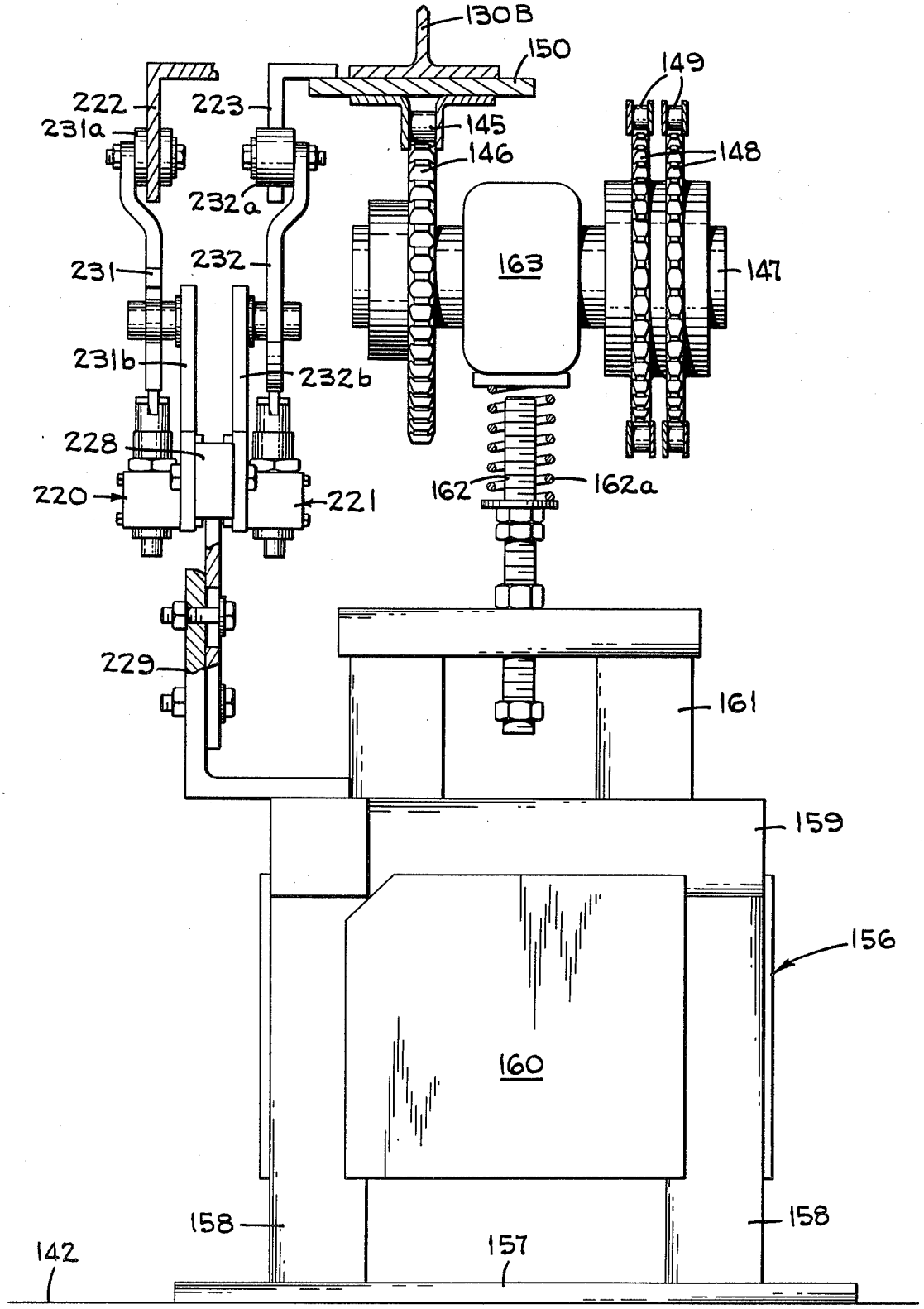
FIG. 19 is an enlarged fragmentary transverse section view taken along line 19—19 of FIG. 4 to further illustrate the cam and deceleration valve arrangement for stopping the transfer table at predetermined locations.

In order for the transfer table 40 to stop automatically at predetermined positions relative to the bin 15 and at predetermined locations along the adjacent platform 55, cam operated deceleration valves 220 and 221 communicate with the reversible transfer table drive motor 155 (FIG. 10). The deceleration valves 220 and 221 are mounted on the motor mount 156 (FIGS. 7, 8, 18 and 19) by means of brackets 229 and 230 that are secured to the support bar 159. Mounted on the channel member 150 by welding or the like are cams 222 and 223, respectively (FIGS. 18 and 19). When the transfer table 40 reaches a predetermined location in section C of the pit 142, the cam 222 engages a cam roller 231*a* of valve actuation arm 231 which actuates the valve 220 to stop the flow of fluid under pressure from the manually operated valve 180 to one output of the fluid motor 155. The valve actuation arms 231 and 232 are supported for pivotal movement by brackets 231*b* and 232*b*, which, in turn, are secured to a horizontal support bar 228. The support bar 28 is supported by the motor mount 156 through the plate 164. When the transfer table 40 reaches a predetermined location in section D of the pit 142, the cam 223 engages a cam roller 232*a* of a valve actuation arm 232 which actuates the valve 221 to stop the flow of fluid from the manually operated valve 180 to another output of the fluid motor 155. Only one of the valves 220 and 221 is actuated by a cam at any given time. Therefore, the reversible motor 155 can be operated through the manually operated valve 180 to move the transfer table 40 in a direction opposite to the location of the engaged cam. Communicating with the valve 180 and the valves 220 and 221 are conventional flow control valves 225 and 226.

While a door is shown at each end of the bin, it is apparent that the module builder of the present invention with a door at one end of the bin would fall within the purview of the present invention. While various manually operated control valves are described, it is also apparent that such control valves can be operated electrically, mechanically or the like.

We claim:

1. Apparatus for making modules comprising:

(a) a bin in which material is deposited for the forming of a module;

(b) a tamping mechanism mounted on said bin for compacting the material in said bin into a module;

(c) a door for said bin movable between an opened and closed position, said door being closed while a module is being formed and said door being opened for the removal of a module from said bin;

(d) means for opening and closing said door;

(e) a transfer table disposed at the base of said bin on which a module is supported; and (f) means moving said transfer table to advance successively sections of said transfer table into said bin at the base thereof for forming modules in succession on said sections of said transfer table and to advance successively sections of said transfer table out of said bin for the removal of modules in succession from said transfer table.

2. Apparatus as claimed in claim 1 and comprising means connected to said bin to raise said bin away from said transfer table for the removal of a module and to lower said bin toward said transfer table for the compacting of material in said bin into a module.

3. Apparatus as claimed in claim 2 wherein said door is pivotally mounted on said bin for movement about a horizontal axis disposed at an upper section of said bin.

4. Apparatus as claimed in claim 3 wherein said bin is formed with confronting ends and confronting sides, said door being mounted at one end of said bin, said means for raising and lowering said bin being connected to each side of said bin, and said apparatus further comprising tracks below said transfer table over which said transfer table rides for movement over a rectilinear path extending lengthwise of said bin.

5. Apparatus as claimed in claim 4 wherein said means moving said transfer table comprises:

(a) a chain fixed to a bottom of said transfer table and extending in a direction parallel with the sides of said bin; and (b) a stationary motor drive arrangement mounted below said transfer table, said stationary motor drive arrangement having a sprocket drive mounted for rotation and disposed in engagement with said chain for moving said transfer table over the rectilinear path extending lengthwise of said bin.

6. Apparatus as claimed in claim 5 wherein said motor drive arrangement includes a reversible motor for driving said sprocket in reversible directions for moving said transfer table in alternate directions over the rectilinear path.

7. Apparatus as claimed in claim 4 wherein said means moving said transfer table comprises:

(a) a rack fixed to a bottom of said transfer table and extending in a direction parallel with the sides of said bin; and (b) a stationary motor drive arrangement mounted below said transfer table, said stationary motor drive arrangement having a pinion drive mounted for rotation and disposed in engagement with said rack for moving said transfer table over the rectilinear path extending lengthwise of said bin.

8. Apparatus as claimed in claim 7 wherein said motor drive arrangement includes a reversible motor for driving said pinion in reversible directions for moving said transfer table in alternate directions over the rectilinear path.

9. Apparatus as claimed in claim 6 wherein said means for moving said transfer table further comprises:

(a) a first deceleration valve means communicating with said reversible motor actuated when said transfer table reaches one predetermined location along said rectilinear path for stopping the reversible motor from moving said transfer table beyond said one predetermined location; and (b) a second deceleration valve means communicating with said reversible motor actuated when said transfer table reaches another predetermined location along said rectilinear path for stopping the reversible motor from moving said transfer table beyond said other predetermined location.

10. Apparatus as claimed in claim 9 and comprising:

(a) a first cam on said transfer table for actuating said first deceleration valve means when said transfer table reaches said one predetermined location; and (b) a second cam on said transfer table for actuating said second deceleration valve means when said transfer table reaches said other predetermined location.

11. Apparatus as claimed in claim 1 and comprising:

(a) means connected to said door for locking said door in a closed position and for unlocking said door for opening said door;

(b) means connected to said door for moving said door between an opened and closed position; and (c) means interconnecting said means for locking and unlocking said door and said means for moving said door to unlock said door before said door is opened and to lock said door after said door is closed.

12. Apparatus as claimed in claim 11 wherein said means for locking and unlocking said door is an hydraulically operated mechanism, said means for moving said door is an hydraulically operated mechanism, and said means for interconnecting said means for locking and for unlocking said door and said means for moving said door includes a sequencing valve.

13. Apparatus for making modules comprising:

(a) an opened bottom bin in which material is deposited for the forming of a module;

a tamping mechanism mounted on said bin for compacting the material in said bin into a module;

(c) a rigid transfer table disposed at the base of said bin to provide a bottom for said bin on which a module is supported; and (d) means connected to said rigid transfer table for moving said rigid transfer table along a path for modules to be formed in said bin in succession on successive sections of said rigid transfer table.

14. Apparatus for making modules as claimed in claim 13 wherein said means comprises a chain-sprocket and motor drive for moving said transfer table along said path.

15. Apparatus for making modules as claimed in claim 13 wherein said means comprises a rack-pinion and motor drive for moving said transfer table along said path.

16. Apparatus for making modules as claimed in claim 13 wherein said tamping mechanism has a vertical reciprocating movement and a horizontal reciprocating movement.

17. Apparatus for making modules comprising:

(a) a bin in which material is deposited for the forming of a module, said bin being formed with confronting ends;

(b) a tamping mechanism mounted on said bin for compacting the material in said bin into a module;

(c) a first door at one end of said bin movable between an opened and closed position, said first door being closed while a module is being formed and said first door being opened for the removal of a module through said one end of said bin;

(d) a second door at the other end of said bin movable between an opened and closed position, said second door being closed while a module is being formed and said second door being opened for the removal of a module through said other end of said bin;

(e) means for opening and closing said first and second doors;

(f) a transfer table disposed at the base of said bin on which a module is supported; and (g) means moving said transfer table to advance successively sections of said transfer table into said bin at the base thereof through alternate ends of said bin for forming modules in succession on said sections of said transfer table and to advance successively said sections of said transfer table out of said bin through alternate ends of said bin for the removal of modules in succession from said sections of said transfer table.

18. Apparatus as claimed in claim 17 wherein said transfer table is at least twice the length of said bin, whereby a module may be formed on one section of said transfer table while a module may be removed from another section of said bin.

19. Apparatus as claimed in claim 18 and comprising means connected to said bin to raise said bin away from said transfer table for the removal of a module and to lower said bin toward said transfer table for the compacting of material in said bin into a module.

20. Apparatus as claimed in claim 19 wherein each of said doors is pivotally mounted on said bin for movement about a horizontal axis disposed at an upper section of said bin.

21. Apparatus as claimed in claim 20 wherein said bin is formed with confronting sides, and wherein said means for raising and lowering said bin being connected to each side of said bin, and said apparatus further comprising tracks below said transfer table over which said transfer table rides for movement over a rectilinear path extending lengthwise of said bin.

22. Apparatus as claimed in claim 21 wherein said means moving said transfer table comprises:

(a) a chain fixed to a bottom of said transfer table and extending in a direction parallel with the sides of said bin; and (b) a stationary motor drive arrangement mounted below said transfer table, said stationary motor drive arrangement having a sprocket drive mounted for rotation and disposed in engagement with said chain for moving said transfer table over the rectilinear path extending lengthwise of said bin.

23. Apparatus as claimed in claim 22 wherein said motor drive arrangement includes a reversible motor for driving said sprocket in reversible directions for moving said transfer table in alternate directions over the rectilinear path.

24. Apparatus as claimed in claim 21 wherein said means moving said transfer table comprises:

(a) a rack fixed to a bottom of said transfer table and extending in a direction parallel with the sides of said bin; and (b) a stationary motor drive arrangement mounted below said transfer table, said stationary motor drive arrangement having a pinion drive mounted for rotation and disposed in engagement with said rack for moving said transfer table over the rectilinear path extending lengthwise of said bin.

25. Apparatus as claimed in claim 24 wherein said motor drive arrangement includes a reversible motor for driving said pinion in reversible directions for moving said transfer table in alternate directions over the rectilinear path.

* * * * *